United States Patent [19]

Haas et al.

[11] 4,152,988

[45] May 8, 1979

[54] ELECTRIC MATCH WITH EPOXY COATED FLUOROCARBON CONTAINING PYROTECHNIC COMPOSITION

[75] Inventors: Davey S. Haas, Bloomington; Claude D. Helton, Springville, both of Ind.

[73] Assignee: The United States of America as represented by the Secretary of the Navy, Washington, D.C.

[21] Appl. No.: 834,218

[22] Filed: Sep. 19, 1977

[51] Int. Cl.[2] ..... F42B 3/12

[52] U.S. Cl. ..... 102/28 M; 149/19.3

[58] Field of Search ..... 149/193; 102/28 M

[56] References Cited

U.S. PATENT DOCUMENTS

| | | | |
|---|---|---|---|
| 3,513,043 | 5/1970 | Burnside | 149/19.3 |
| 3,717,096 | 2/1973 | Ward | 102/28 M |
| 3,753,811 | 8/1973 | Julian et al. | 149/19.3 |
| 3,763,783 | 10/1973 | Thomas et al. | 102/28 M |
| 3,765,334 | 10/1973 | Rentz et al. | 149/19.3 |
| 3,804,018 | 4/1974 | Janoski | 102/28 M |
| 3,876,477 | 4/1975 | Eldridge et al. | 149/19.3 |
| 3,910,188 | 10/1975 | Stevens | 102/28 M |
| 4,062,709 | 12/1977 | Castaneda et al. | 149/19.3 |

FOREIGN PATENT DOCUMENTS

| | | | |
|---|---|---|---|
| 741853 | 4/1970 | Belgium | 149/19.3 |

*Primary Examiner*—Edward A. Miller

*Attorney, Agent, or Firm*—R. S. Sciascia; Paul S. Collignon

[57] ABSTRACT

A method of making an electric match having an electrical assembly of a pair of lead-in wires and a bridge wire comprising dipping said electrical assembly into a pyrotechnic composition comprised of magnesium, polytetrafluoroethylene, and fluorocarbon rubber, and then drying said pyrotechnic composition to form a match head around said bridge wire. A waterproofing coating is applied to the match head by dipping into an epoxy coating composition.

1 Claim, 1 Drawing Figure

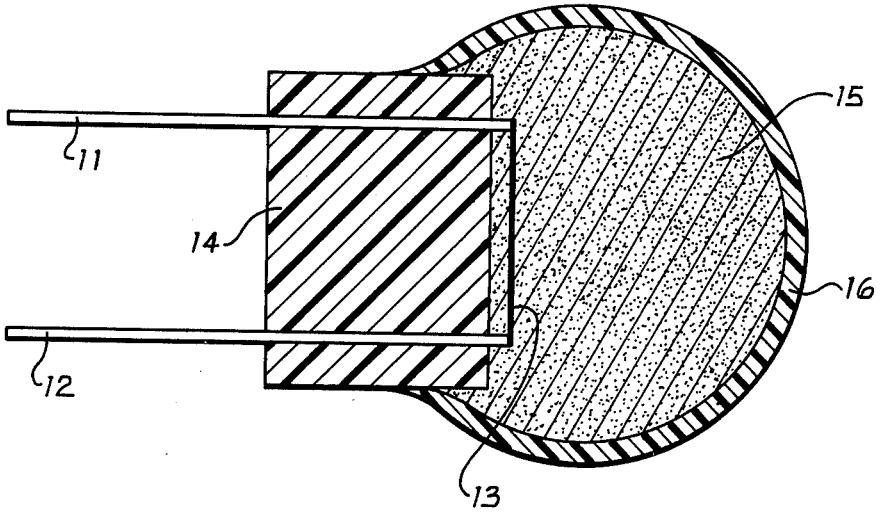
11
12
13
14
15
16

ELECTRIC MATCH WITH EPOXY COATED FLUOROCARBON CONTAINING PYROTECHNIC COMPOSITION

BACKGROUND OF THE INVENTION

The present invention relates to an electric match or detonator and more particularly to an electric match which will ignite after being subjected to severe moisture and environmental conditions.

Various compositions are being used as ignition compositions for electric match and electric blasting detonators. One composition presently being used by the military in an electric match designated as M100 is comprised of potassium chlorate, lead monitro resourcinate and nitrocellulose priming material in conjunction with a chlorate, charcoal and lacquer mixture. A clear lacquer is applied for use as a protective coating. The heretofore available electric matches have a high failure rate when subjected to water or high humidity and also after extended periods of storage.

Another composition used for electric blasting detonators is described in U.S. Pat. No. 3,173,367, which issued Mar. 16, 1965, to Roy L. Shinpaugh. This patent describes an ignition composition which is comprised of between 65 and 78 percent of barium chromate, between 7 and 16 percent of boron and between 10 and 20 percent of lead dioxide.

SUMMARY OF THE INVENTION

The present invention relates to an electric match and method for making same so that the match will have improved performance after exposure to moisture. An electrical assembly is comprised of a pair of lead-in wires which have a bridgewire connected across the ends and the electrical assembly is dipped into a pyrotechnic composition so that a match head is formed around the bridgewire. The pyrotechnic composition is comprised of atomized magnesium, plastic molding material and fluorocarbon rubber. After dipping the electrical assembly into the pyrotechnic composition, the assembly is rotated while the pyrotechnic composition is drying so that a symmetrical match head is formed. After drying, the match head is dipped into a waterproofing composition comprised of liquid epoxy and a hardener.

It is therefore a general object of the present invention to provide an electric match which will provide improved performance after exposure to moisture and severe environmental conditions.

Another object of the present invention is to provide a method for making a waterproofed electric match.

Other objects, advantages and novel features of the present invention will become apparent from the following detailed description of the invention when considered in conjunction with the accompanying drawing.

BRIEF DESCRIPTION OF THE DRAWING

The FIGURE of the drawing is an enlarged sectional view of an improved electric match made according to the teachings of the present invention.

DESCRIPTION OF THE PREFERRED EMBODIMENT

Referring to the drawing, there is shown an electric match which has been made according to the teachings of the present invention. The electrical assembly of the match is comprised of leads 11 and 12 having a bridgewire 13 attached to one end of each lead. Leads 11 and 12 are supported by a suitable insulating header 14. A pyrotechnic composition forms a match head 15 and covers bridgewire 13, and a waterproof coating 16 covers the outer surface of match head 15.

Match head 15 is comprised, by weight, of 54 percent of atomized magnesium, 30 percent of plastic molding material, which is polytetrafluoroethylene, and 16 percent of fluorocarbon rubber. In electric match assemblies mixed and tested at the Naval Weapons Support Center, Crane, Indiana, it has been determined that the following tolerances can be used: for magnesium, plus or minus 2 percent; for polytetrafluoroethylene, plus or minus 2 percent; and for fluorocarbon rubber, plus or minus 2 percent.

The following example will illustrate the method of making the electric match shown in the drawing.

FORMULATION

| | |
|---|---|
| Atomized magnesium | 54% |
| Polytetrafluoroethylene (Type IV, Class 1) | 15% |
| Polytetrafluoroethylene (Type I, Class 1 or 2) | 15% |
| Fluorocarbon rubber | 16% |

Polytetrafluoroethylene Type I and Type IV are described in Federal Specification L-P-403c, entitled, "Plastic Molding Material, Polytetrafluoroethylene". Types I and IV are both granular powders and Type IV, Class 1, has an apparent density of $250^{\pm 75}$ g/liter. Type IV was selected as it provides better ignition than the other types. Type I, Class 1 or 2, was used as it facilitates consistent burning. Type I, Class 1, has an apparent density of $500^{\pm 50}$ g/liter and Class 2 has an apparent density of $625^{\pm 50}$ g/liter.

The fluorocarbon rubber was dissolved in acetone to make a solution of about four parts of acetone and one part of fluorocarbon rubber. The fluorocarbon rubber which was used was procured from E. I. DuPont de Nemours Company under the trade name Viton A. Viton A has the formula $(C_3H_2F_4)_x$ and is comprised of about 32.1 percent of carbon, about 1.8 percent of hydrogen, and about 66.1 percent of florine. After mixing, the mixture was air dried to remove all solvent and the dried composition was passed through a #20 Tyler Sieve.

The prepared fluorocarbon rubber was then mixed with the atomized magnesium, which has been passed through a #325 Tyler Sieve, and the polytetrafluoroethylene and blended with acetone in amount of $1.00^{\pm 0.05}$ milliliter acetone per gram of composition. The ingredients and solvent were blended to provide a completely wet composition.

The electrical assembly which is comprised of leads 11 and 12, header 14 and bridgewire 13 was immersed in the wet mixture several times until a bead or head of composition was formed. The head formed was about three-sixteenths inch in diameter and, after removal from the wet mixture, the unit was rotated so that a symmetrical or rounded head was formed. The composition was dried until all the acetone evaporated. The weight of the dried composition was about 0.080 grams.

After the match head was dried, it was dipped several times in liquid epoxy and hardener having the following formulation:

Epoxy based resin (D. E. R. 721)—65%
Hardener (D. E. H. 14)—35%

The epoxy resin and hardener was obtained from The Dow Chemical Company, Midland, Mich. The resin and hardener are marketed by The Dow Chemical Company under the trademarks D. E. R. 721 and D. E. H. 14. The epoxy resin is a liquid epoxy resin of the Bisphenol A epichlorohydrin type containing cresyl glycidyl ether.

After dipping, the epoxy was dried and the hardened coating was about 0.005 to 0.010 inch thick.

In tests conducted at the Naval Weapons Support Center, Crane, Ind., two units made according to the above-described method and two standard M100 electric matches were exposed to weather (−5° to 50° F.) for 15 days and then submerged under water for 48 hours. The two epoxy coated units were ignited by an electric current and exhibited an intense flash of fire and a quick response. Both of the standard M100 units failed to emit any fire or flash.

It can thus be seen that electric matches made according to the teachings of the present invention provide significant improvement over heretofore available electric matches after subjection to water or high humidity.

Obviously many modifications and variations of the present invention are possible in the light of the above teachings. It is therefore to be understood that the invention may be practiced otherwise than as specifically described.

We claim:

1. An electric match comprising, an electric assembly having first and second lead-in wires and a bridgewire connected across the ends of said lead-in wires, a pyrotechnic composition covering said bridgewire comprised, by weight, of between 52 and 56 percent of atomized magnesium, between 28 and 32 percent of polytetrafluoroethylene and between 14 and 18 percent of fluorocarbon rubber, and a waterproof coating covering said pyrotechnic composition, said waterproof coating being the reaction product of about 65 percent, by weight, of a liquid epoxy and about 35 percent, by weight, of an epoxy hardener.

* * * * *